US009528058B2

(12) United States Patent
Dubois et al.

(10) Patent No.: US 9,528,058 B2
(45) Date of Patent: Dec. 27, 2016

(54) AVIATION FUEL COMPOSITION

(71) Applicants: Arkema France, Colombes (FR); Process Design Center BV, Breda (NL); OBR Spólka Akcyjna, Plock (PL)

(72) Inventors: Jean-Luc Dubois, Millery (FR); Wei Zhao, Breda (NL); Raf Edward Anna Roelant, Breda (NL); Hans Keuken, Wuustwezel (BE); Antoni Gnot, Rzeszow (PL); Jacek Paczesniak, Boguchwala (PL)

(73) Assignees: ARKEMA FRANCE, Colombes (FR); OBR SPÓLKA AKCYJNA, Plock (PL)

( * ) Notice: Subject to any disclaimer, the term of this patent is extended or adjusted under 35 U.S.C. 154(b) by 0 days.

(21) Appl. No.: 14/588,663

(22) Filed: Jan. 2, 2015

(65) Prior Publication Data

US 2015/0191667 A1 Jul. 9, 2015

(30) Foreign Application Priority Data

Jan. 3, 2014 (EP) ..... 14150137

(51) Int. Cl.

| | |
|---|---|
| ***C10L 1/18*** | (2006.01) |
| ***C10L 1/182*** | (2006.01) |
| ***C10L 1/02*** | (2006.01) |
| ***C10L 10/02*** | (2006.01) |

(52) U.S. Cl.

CPC ..... *C10L 1/1824* (2013.01); *C10L 1/02* (2013.01); *C10L 10/02* (2013.01); *C10L 2200/043* (2013.01); *C10L 2200/0469* (2013.01); *C10L 2270/04* (2013.01); *C10L 2290/24* (2013.01)

(58) Field of Classification Search

CPC ..... C10L 1/1824; C10L 1/02; C10L 10/02; C10L 2200/043; C10L 2200/0469; C10L 2270/04; C10L 2290/24

See application file for complete search history.

(56) References Cited

U.S. PATENT DOCUMENTS

| | | | | |
|---|---|---|---|---|
| 2004/0060226 | A1* | 4/2004 | Bongart | C10L 1/026 44/398 |
| 2009/0151230 | A1* | 6/2009 | Clayton | C10L 1/14 44/302 |
| 2010/0210492 | A1 | 8/2010 | Lange et al. | |

FOREIGN PATENT DOCUMENTS

| | | | |
|---|---|---|---|
| AU | 2007231780 | A1 | 5/2009 |
| EP | 0117915 | A2 | 9/1984 |
| WO | 9503376 | A1 | 2/1995 |
| WO | WO 0238709 | A2 | 5/2002 |
| WO | 2009056589 | A1 | 5/2009 |
| WO | 2013087211 | A1 | 6/2013 |

OTHER PUBLICATIONS

Extended European Search Report for Application No. EP 14 15 0137 published by the EPO, dated May 14, 2014, including corresponding Communication, Annex and 5-page EPO Form 1703.

* cited by examiner

*Primary Examiner* — Cephia D Toomer

(74) *Attorney, Agent, or Firm* — Kilyk & Bowersox, P.L.L.C.

(57) ABSTRACT

The present invention relates to an aviation fuel composition comprising an energy providing component that includes 70 to 99.9 vol. % of a hydrocarbon mixture, and 0.1 to 30 vol. % of an alcohol component selected from the group consisting of one or more Guerbet alcohols, having a number or mean value of number of carbon atoms, respectively, of equal to or less than 12, and optionally one or more aviation fuel additives. The invention further relates to a method for manufacturing the aviation fuel composition.

13 Claims, No Drawings

AVIATION FUEL COMPOSITION

FUNDING

The research leading to these results has received funding from the European Union Seventh Framework Programme (FP7/2007-2013) under grant agreement no 241718 Euro-BioRef.

FIELD OF THE INVENTION

The present invention relates to aviation fuels, and in particular to aviation turbine fuels, also called jet fuels. The present invention further relates to aviation fuels composed of fossil fuel components blended with fuel components from renewable resources.

BACKGROUND OF THE INVENTION

Almost all aviation turbine fuels yet fuels) are currently made from fossil sources, with most of it being refined from crude petroleum and a small amount derived from other sources like coal or natural gas. Jet fuels from refined petroleum and in particular kerosene-type jet fuels are currently preferred because they offer the best combination in terms of energy content, performance, availability, ease of handling and price. The past increases in the price of petroleum, concerns about its future availability and security of supply as well as concerns with regard to the emission of greenhouse gases and emission of pollutants have prompted governments and industry to look for alternatives.

For economic as well as safety reasons, alternative aviation turbine feels have to be suited for use with conventional turbine engines, i.e. without requiring any modification of the engines, and have to show the same essential fuel performance properties than conventional jet fuel. In other words, alternative aviation turbine fuels have to comply with the major specifications for commercial jet fuel as issued by ASTM (American Society for Testing and Materials), MOD (United Kingdom Ministry of Defence), or GOST (Gosudarstwenny Standart).

Irrespective of whether conventional or alternative aviation turbine fuels are concerned, the primary function of any jet fuel is to provide a source of chemical energy for propelling a jet aircraft. The key fuel performance properties are therefore energy content and combustion quality. Other essential fuel properties are homogeneity, stability, lubricity, fluidity, cleanliness, and safety properties.

The energy content of a fuel determines how far an aircraft can fly and is expressed either gravimetrically as energy per unit mass of fuel or volumetrically as energy per unit volume of fuel. The combustion quality concerns the radiant heat transfer in turbine engines and is correlated with the flame temperature, the formation of carbonaceous particles in the process of combustion and the formation of smoke and soot. Stability requires that the fuel properties remain unchanged over time and when exposed to high temperatures in the engine. One of the stability requirements is homogeneity, which means that components concerned are miscible with each other and there is no phase separation in the applicable temperature range. Since jet engines rely on the fuel to lubricate some moving parts in fuel pumps and flow control units, aviation turbine fuels have to feature some lubricity. Fluidity concerns a fuel's ability to be freely supplied from the fuel tanks to the turbine engines of an aircraft, since otherwise an aircraft engine would not able to function. Fluidity concerns the low temperature stability of a fuel usually characterised by its freezing or clouding point below which one of the fuel components solidifies, its viscosity, volatility, and its non-corrosivity, that is its ability not to affect any materials present in the fuel and combustion systems. Fuel cleanliness means the absence of particulates like rust, dirt, and microorganisms, and free water or water-fuel emulsions in the fuel that can plug fuel filters and increase fuel pump wear. Safety properties concern the handling of the fuel and in particular its ignitability characterised by the flash point temperature and its ability to prevent formation of static charges.

The carbon dioxide impact on the environment due to the combustion of fossil fuels in an aircraft is primarily given by the amount of carbon in the fuel consumed in the combustion process and the carbon dioxide produced upon refining and transportation of the raw materials and distribution of the final product. Efforts have therefore been made to reduce the carbon dioxide impact to below the amount of carbon dioxide produced upon manufacture and combustion of jet fuel. One promising attempt is the manufacture of jet fuel as a whole or in part from renewable resources, the stock of which may be regenerated over a short period on the human scale, with the materials of the renewable resources corresponding to organic materials whose carbons come from non-fossil resources (see ASTM D 6866). The carbon dioxide impact on the environment can particularly be reduced when using jet fuel or jet fuel components derived from biomass, since its carbon content has been obtained by capturing atmospheric carbon dioxide through photosynthesis.

A respective manufacture of renewable biofuels is for instance disclosed in the International Publication WO 2009/079213, where saturated $C_8$-$C_{24}$ aliphatic hydrocarbons and aromatics are produced from renewable alcohols (with low levels of olefins) derived from biomass. The biofuel can be used as on-specification fuel either alone or blended with petroleum-derived fuels (e.g. jet fuels).

The term biofuel is understood as meaning a renewable transportation fuel resulting from biomass conversion. Renewable fuels are characterised by comprising carbon of renewable origins, that is to say identifiable by the $^{14}C$ content. Carbon taken from living organisms and in particular from plant matter used to manufacture renewable fuel is a mixture of three isotopes, $^{12}C$, $^{13}C$, and $^{14}C$ being kept constant at $1.2 \cdot 10^{-12}$ by the continuous exchange of the carbon with the environment. Although $^{14}C$ is radioactively unstable with its concentration therefore decreasing over time, with a half-life of 5,730 years, so that the $C^{14}$ content is considered to be constant from the extraction of the plant matter up to the manufacture of the renewable fuels and even up to the end of their use. A fuel can be designed as renewable fuel or biofuel when the $^{14}C/^{12}C$ ratio is strictly greater than zero and smaller or equal to $1.2 \cdot 10^{-12}$.

It has been found that replacing portions of the hydrocarbons in motor fuels, such as diesel oil and gas oil, with alcohol compounds provides a cleaner exhaust emission and does not adversely affect engine performance. The widely available and inexpensive alcohols, methanol and ethanol, are however immiscible with diesel and gas oil fuels resulting in an initial unstable homogeneity of the motor fuel. The European Patent Specification EP 1 218 472 B2 therefore suggests to use a blend of oxygen-containing compounds comprising at least four oxygen-containing functional groups, wherein those groups are contributed to by four different oxygen-containing compounds, each of which contains at least one of said groups, by employing at least four types of organic compounds differing in functional groups containing bound oxygen. The blend can be used for operating diesel, gas-turbine, and turbojet engines either alone or combined with a hydrocarbon component.

Another approach is disclosed in U.S. Pat. No. 6,896,708, where particularly selected so-called non-linear long-chain saturated alcohols (NLA) are used in fuel compositions for internal combustion engines.

U.S. Pat. No. 8,277,522 suggests a mixture of mixed alcohol formulations that can contain combinations of two or more or three or more alcohols, or a blend of $C_1$-$C_5$ alcohols, $C_1$-$C_8$ alcohols, or higher $C_1$-$C_{10}$ alcohols. The mixed alcohol formulations can be used as fuel additive in petroleum and other fuels like e.g. jet fuel or as a neat fuel in and of itself. The primary benefits of the mixed alcohols are said to be increased combustion efficiencies, improved fuel economies, reduced emission profiles and low production costs. Since the presence of oxygen renders the energy content of the lower alcohols methanol ($C_1$) and ethanol ($C_2$) relatively low, the higher alcohols are used to boost the energy content.

In the light of the above it is therefore desirable to provide an aviation feel composition requiring no modification of currently used turbine engines and having, when compared to currently approved aviation fuels, at least one of the following advantages: lower carbon dioxide impact on the environment, lower emission of harmful exhaust gases, and improved characteristics.

SUMMARY OF THE INVENTION

A respective aviation fuel composition comprises an energy providing component, including 70 to 99.9 vol. % of a hydrocarbon mixture, and 0.1 to 30 vol. % of an alcohol component selected from the group consisting of one or more Guerbet alcohols, having a number or mean value of number of carbon atoms, respectively, of equal to or less than 12, preferably less than 12, and optionally one or more aviation fuel additives.

It should be noted in this context that the terms "comprise", "include", "having", and "with", as well as grammatical modifications thereof used in this specification or the claims, indicate the presence of technical features such as stated components, figures, integers, steps or the like, and do by no means preclude the presence or addition of one or more other features, particularly other components, integers, steps or groups thereof.

The respective aviation fuel composition can be provided by a method for manufacturing an aviation fuel composition comprising steps for providing a liquid phase hydrocarbon mixture, providing an alcohol component selected from the group consisting of one or more Guerbet alcohols, having a number or mean number of carbon atoms, respectively, of equal to or less than 12, and mixing the hydrocarbon mixture with the alcohol component in a ratio from the range of 99.9/0.1 to 70/30 with respect to vol. %.

Further, an alcohol component selected from the group consisting of one or more Guerbet alcohols, having a number or mean value of number of carbon atoms, respectively, of equal to or less than 12, can be used as energy providing component in an aviation fuel composition, particularly for reducing the carbon dioxide impact on the environment, lowering the emission of harmful exhaust gases, and improving the fuel characteristics.

Still further, an alcohol component selected from the group consisting of one or more Guerbet alcohols, having a number or mean value of number of carbon atoms, respectively, of equal to or less than 12, can be used to improve the electrical conductivity of an aviation fuel composition.

In embodiments of the respective aviation fuel composition, the energy providing component includes 80 to 95 vol. % of a hydrocarbon mixture, and 5 to 20 vol. % Guerbet alcohol(s).

In other embodiments of the respective aviation fuel composition, the energy providing component, includes 85 to 95 vol. % of a hydrocarbon mixture, and 5 to 15 vol. % Guerbet alcohol(s).

In further embodiments of the respective aviation fuel composition, the energy providing component includes i) 98 to 99.9 vol. % hydrocarbon mixture, and ii) 0.1 to 2 vol. % Guerbet alcohol(s) for advantageously improving the electrical conductivity of the resulting composition.

In embodiments of the respective aviation fuel composition, the hydrocarbon mixture, is a kerosene-type fuel, whereby said hydrocarbon mixture is in particular compositions of these embodiments formed by Jet Fuel A and/or Jet Fuel A-1.

In embodiments of the respective aviation fuel composition, the alcohol component is obtained at least in part from renewable resources.

Embodiments of the respective aviation fuel composition have the alcohol component been selected from the group consisting of 2-methyl-1-pentanol, 2-ethyl-1-hexanol, and 2-propyl-1-heptanol.

In other embodiments of the respective aviation fuel composition, the alcohol component is 2-ethyl-1-hexanol.

Still other embodiments of the respective aviation fuel composition have the alcohol component being a mixture of Guerbet alcohols, comprising two or more Guerbet alcohols having carbon atom numbers of 5, 6, 7, 8, 9, 10.

Embodiments of the respective aviation fuel composition may further comprise one or more aviation fuel additives selected from a group consisting of anti-icing agents, antioxidants, corrosion inhibitors, lubricity improvers, metal deactivators, static dissipators, electrical conductivity additives, biocides, thermal stability improvers or their mixtures.

Further features of the invention will be apparent from the description of embodiments of the invention together with the claims. Embodiments of the invention may implement single features or several features in combination.

DETAILED DESCRIPTION OF THE INVENTION

The aviation fuel composition comprises a hydrocarbon mixture and one or more specific Guerbet alcohols in a specific proportion of mixture as energy providing component, and optionally one or more aviation fuel additives. In preferred embodiments, the energy providing component contains, apart from impurities in the usual amounts, no oxygen containing compounds other than Guerbet alcohols, and in particularly preferred embodiments, the energy providing component is, except for the usual impurities, comprised of a hydrocarbon mixture and one or more Guerbet alcohols only. The impurities refer to the impurities in the hydrocarbon mixture as well as to the impurities in the Guerbet alcohols and depend on the respective manufacturing process of each constituent.

With regard to the hydrocarbon mixture, said mixture conforms to selected specification properties of jet fuels, in particular for aviation fuels or military jet fuels.

Jet fuel or aviation turbine fuel (ATF) is a mixture of a large number of different hydrocarbon compounds, whereby the identity of any individual compound present in jet fuel is presently still not known. Accordingly hydrocarbon type fuel is typically specified by various physical characteristics, as for example density, gravimetric and volumetric energy content, distillation characteristics, flash point, freezing point, ignition temperature, viscosity, smoke point, acidity, electrical conductivity, and so on. Reference is made for example to Aviation Fuels Technical Review (FTR-3), 2005, Chevron, listing different jet fuel specifications.

Kerosene-type jet fuel (e.g. Jet A-1, Jet A) has a carbon number distribution between about 8 and 16 carbon atoms per molecule, whereas wide-cut jet fuel (e.g. Jet B) has a carbon number distribution between about 5 and 15.

Selected specification properties of jet fuels are summarized in the following Table 1.

TABLE 1

Physical properties of jet fuels

| | Fuel Type | | |
|---|---|---|---|
| | Jet A-1 | Jet A | Jet B |
| Specification | DEF STAN 91-91 | ASTM D 1655 | CGSB-3.22 |
| Aromatics (% vol, max) | 25.0 | 25.0 | 25.0 |
| Net heat of combustion (MJ/kg, min) | 42.8 | 42.8 | 42.8 |
| Density at 15° C. (kg/m$^3$) | 775-840 | 775-840 | 750-801 |
| Flash point (° C., min) | 38° C. | 38° C. | / |
| Freezing point (° C., max) | −47° C. | −40° C. | −51° C. |
| Viscosity (−20° C., mm$^2$/s, max) | 8.0 | 8.0 | / |
| Smoke point (mm, min) | 19 | 18 | 20 |
| Distillation end point (° C.) | 300 | 300 | 270 |

The major specifications for commercial jet fuels are issued by ASTM (American Society for Testing and Materials), MOB (United Kingdom Ministry of Defence), GOST (Gosudarstwenny Standart), and GB 6537 China standard (Jet fuel No 3). Jet or aviation fuels complying with one of the standards for military or civilian, (commercial) jet fuels are in the following referred to as on-specification fuels. The most commonly used fuels for commercial aviation are Jet A and Jet A-1, Jet B or GOST TS-1, each of which complies with one of the standardised international specifications.

Preferably kerosene-type fuels of fossil origin and in particular Jet A-1 and Jet-A are used as hydrocarbon mixture in the Guerbet alcohol containing aviation fuel composition indicated above. But also on-specification Fischer-Tropsch synthetic fuels (FT-synfuels) or respective blends of FT-synfuels and fossil origin kerosene-type fuels can be used. Further, also on-specification hydrocarbon mixtures, e.g. those described in WO 2009/079213 A2, produced from renewable resources like biomass may form the hydrocarbon mixture component or a part of it. It is appreciated that also hydrocarbon mixtures conforming to military jet fuel specifications may form the hydrocarbon component of the above Guerbet alcohol containing aviation fuel composition.

With respect to the Guerbet alcohols included in the jet fuel composition according to the invention, said alcohols are saturated primary alcohols with a defined branching of the carbon chain. The term Guerbet alcohol as used in this specification is to be understood as a monofunctional, primary alcohol comprising at least a branching at the carbon atom adjacent to the carbon atom carrying the hydroxyl group, and is defined independent of the production method used. Chemically, Guerbet alcohols axe described as 2-alkyl-1-alkanols.

Guerbet alcohols are well known in the state of the art. The term 'Guerbet' alcohol refers to the Guerbet reaction, named after Marcel Guerbet, which is an autocondensation converting a primary aliphatic alcohol into its β-alkylated dimer alcohol with loss of one equivalent of water. The Guerbet reaction requires a catalyst and elevated temperatures.

The above reaction mechanism leading to Guerbet alcohols comprises essentially the following steps:

First, a primary alcohol of the formula $RCH_2CH_2OH$, wherein R may be a straight or branched chain alkyl group having 1 to 20 carbon atoms or a hydrogen atom, is dehydrogenated (or oxidised) to the respective aldehyde. In the following, two aldehyde molecules undergo an aldol condensation to an α,β-unsaturated aldehyde, which is finally hydrogenated to the "dimer" alcohol. The catalyst used for this reaction may be of alkaline nature (e.g. potassium hydroxide, sodium hydroxide, sodium tert.-butoxide, etc.) eventually in the presence of a platinum or palladium catalyst. Usually the reaction takes place under heating and possibly pressurizing the reaction mixture.

An example for a process for preparing branched dimer alcohols based on the Guerbet reaction is for instance disclosed in EP 0 299 720 B1.

A Guerbet alcohol may also have two or more branches, particularly if it is the product of two or more subsequent condensation reactions. For example, 2-ethyl-1-hexanol, the Guerbet dimer of 1-butanol, may react with 1-propanol to yield 4-ethyl-2-methyl-1-octanol. This further increases the variety of Guerbet alcohols.

The chain length of a Guerbet alcohol produced according to the above reaction depends on the primary alcohol used as a starting material. When e.g. producing 2-ethyl-1-hexanol, n-butanol has to be used as a starting material. The Guerbet condensation may also be performed with a mixture of starting alcohols differing from each other in the number of carbon atoms, whereby a mixture of products is produced according to the different possible condensations. When starting for example with 1-butanol ($C_4$) and 1-pentanol ($C_5$), the reaction results 2-ethyl-1-hexanol ($C_8$), 2-ethyl-1-heptanol ($C_9$), 2-propyl-1-hexanol ($C_9$), and 2-propyl-1-heptanol ($C_{10}$). With a feeding of a larger number of diverse alcohols, a greater variety of Guerbet alcohols is obtained. In the following tables, a non-exhaustive listing of examples is given for Guerbet alcohols obtained using one type or different types of primary alcohols as starting materials according to the following reaction scheme:

Alcohol 2→Aldehyde 2

Aldehyde 2+Alcohol 1→Guerbet alcohol

In the tables, the Guerbet alcohols are represented by the respective carbon number of the main chain and the kind and position, of the substituent(s), the hydroxyl group of the alcohols being omitted in the table.

The following abbreviations are used in the tables below: Me=methyl, diMe=dimethyl, triMe=trimethyl, Et=ethyl, Pr=propyl, iPr=—$CH(CH_3)_2$, Bu=butyl, iBu=—$CH_2CH(CH_3)_2$, sBu=—$CH(CH_3)$—$CH_2CH_3$, Pe=pentyl, A=amyl, iA=—$CH_2CH_2CH(CH_3)_2$, sA=—$CH(CH_3)$—$CH_2CH_2CH_3$, s'A=—$CH_2$—$CH(CH_3)$—$CH_2CH_3$, i=iso, s=sec, specifying the substituents on the main chain of the Guerbet alcohol. The number preceding the substituents gives the position of the substituent on the main chain.

The number subsequent to "C" specifies the length of the main chain, i.e. stands for the number of carbon atoms in the main chain of the Guerbet alcohol with the hydroxyl group always in position 1 (primary alcohol).

For example, 2MeC4 stands for 2-methyl-butanol, 2Et4MeC5 stands for 2-ethyl-4-methyl-1-pentanol, and 2iBu4MeC5 stands for 2-isobutyl-4-methyl-1-pentanol. X stands for a reaction which is either impossible or difficult.

TABLE 2a

| Guerbet reactions | | | | | | |
|---|---|---|---|---|---|---|
| | Alcohol 1 | Methanol | Ethanol | Propanol | Butanol | Isobutanol |
| Alcohol 2 | | C1 | C2 | C3 | C4 | iC4 |
| Methanol | C1 | x | Propanol | 2MeC3 | 2MeC4 | x |
| Ethanol | C2 | x | Butanol | 2MeC4 | 2EtC4 | x |
| Propanol | C3 | x | Pentanol | 2MeC5 | 2EtC5 | x |
| Butanol | C4 | x | C6 | 2MeC6 | 2EtC6 | x |
| Isobutanol | iC4 | x | 4MeC5 | 2,4diMeC5 | 2Et4MeC5 | x |
| Pentanol | C5 | x | C7 | 2MeC7 | 2EtC7 | x |
| 2MethylBuOH | 2MeC4 | x | 4MeC6 | 2,4diMeC6 | 2Et4MeC6 | x |
| 3MethylBuOH | 3MeC4 | x | 5MeC6 | 2,5diMeC6 | 2Et5MeC6 | x |

TABLE 2b

| Guerbet reactions | | | | |
|---|---|---|---|---|
| | Alcohol 1 | Pentanol | 2MethylBuOH | 3MethylBuOH |
| Alcohol 2 | | C5 | 2MeC4 | 3MeC4 |
| Methanol | C1 | 2MeC5 | x | 2,3DiMeC4 |
| Ethanol | C2 | 2EtC5 | x | 2Et3MeC4 |
| Propanol | C3 | 2PrC5 | x | 2Pr3MeC4 |
| Butanol | C4 | 2PrC6 | x | 2iPrC6 |

TABLE 2b-continued

| Guerbet reactions | | | | |
|---|---|---|---|---|
| | Alcohol 1 | Pentanol | 2MethylBuOH | 3MethylBuOH |
| Isobutanol | iC4 | 2Pr4MeC5 | x | 2iPr4MeC5 |
| Pentanol | C5 | 2PrC7 | x | 2iPrC7 |
| 2MethylBuOH | 2MeC4 | 2Pr4MeC6 | x | 2iPr4MeC6 |
| 3MethylBuOH | 3MeC4 | 2Pr5MeC6 | x | 2iPr5MeC6 |

TABLE 2c

| Guerbet reactions | | | | | | | |
|---|---|---|---|---|---|---|---|
| | Alcohol 1 | Hexanol | | | | | |
| Alcohol2 | | C6 | 2MeC5 | 3MeC5 | 4MeC5 | 2,3DiMeC4 | 2EtC4 |
| Methanol | C1 | 2MeC6 | x | 2,3diMeC5 | 2,4diMeC5 | x | x |
| Ethanol | C2 | 2EtC6 | x | 2Et3MeC5 | 2Et4MeC5 | x | x |
| Propanol | C3 | 2PrC6 | x | 2Pr3MeC5 | 2Pr4MeC5 | x | x |
| Butanol | C4 | 2BuC6 | x | 2Bu3MeC5 | 2iBuC6 | x | x |
| Isobutanol | iC4 | 2Bu4MeC5 | x | 2iBu3MeC5 | 2iBu4MeC5 | x | x |
| Pentanol | C5 | 2BuC7 | x | 2Pe3MeC5 | 2Pe4MeC5 | x | x |
| 2MethylBuOH | 2MeC4 | 2Bu4MeC6 | x | 2sBu4MeC6 | 2iBu4MeC6 | x | x |
| 3MethylBuOH | 3MeC4 | 2Bu5MeC6 | x | 2sBu5MeC6 | 2iBu5MeC6 | x | x |

TABLE 2d

| Guerbet reactions | | | | | | |
|---|---|---|---|---|---|---|
| | Alcohol 1 | Hexanol | | | | |
| Alcohol2 | | C7 | 2MeC6 | 3MeC6 | 4MeC6 | 5MeC6 |
| Methanol | C1 | 2MeC7 | x | 2,3diMeC6 | 2,4DiMeC6 | 2,5DiMeC6 |
| Ethanol | C2 | 2EtC7 | x | 2Et3MeC6 | 2Et4MeC6 | 2Et5MeC6 |
| Propanol | C3 | 2PrC7 | x | 2Pr3MeC6 | 2Pr4MeC6 | 2Pr5MeC6 |
| Butanol | C4 | 2BuC7 | x | 2Bu3MeC6 | 2Bu4MeC6 | 2Bu5MeC6 |
| Isobutanol | iC4 | 2iBuC7 | x | 2iBu3MeC6 | 2iBu4MeC6 | 2iBu5MeC6 |
| Pentanol | C5 | 2PeC7 | x | 2sAC7 | 2s'AC7 | 2iAC7 |
| 2MethylBuOH | 2MeC4 | 2Pe4MeC6 | x | 2sA4MeC6 | 2s'A4MeC6 | 2iA4MeC6 |
| 3MethylBuOH | 3MeC4 | 2Pe5MeC6 | x | 2sA5MeC6 | 2s'A5MeC6 | 2iA5MeC6 |

TABLE 2e

| Guerbet reactions | | | | | |
|---|---|---|---|---|---|
| | Alcohol 1 | Heptanol | | | |
| Alcohol 2 | | 3,3diMeC5 | 3,4diMeC5 | 4,4diMeC5 | 3EtC5 |
| Methanol | C1 | 2,3,3triMeC5 | 2,3,4triMeC5 | 2,4,4,triMeC5 | 2Me3EtC5 |
| Ethanol | C2 | 2Et3,3diMeC5 | 2Et3,4diMeC5 | 2Et4,4diMeC5 | 2Et3EtC5 |
| Propanol | C3 | 2Pr3,3diMeC5 | 2Pr3,4diMeC5 | 2Pr4,4diMeC5 | 2Pr3EtC5 |
| Butanol | C4 | 2Bu3,3diMeC5 | 2Bu3,4diMeC5 | 2Bu4,4diMeC5 | 2Bu3EtC5 |

TABLE 2e-continued

| Guerbet reactions | | | | | |
|---|---|---|---|---|---|
| | Alcohol 1 | Heptanol | | | |
| Isobutanol | iC4 | 2iBu3,3diMeC5 | 2iBu3,4diMeC5 | 2iBu4,4diMeC5 | 2iBu3EtC5 |
| Pentanol | C5 | 2Pe3,3diMeC5 | 2Pe3,4diMeC5 | 2Pe4,4diMeC5 | 2Pe3EtC5 |
| 2MethylBuOH | 2MeC4 | 2s'A3,3diMeC5 | 2s'A3,4diMeC5 | 2s'A4,4diMeC5 | 2s'A3EtC5 |
| 3MethylBuOH | 3MeC4 | 2iA3,3diMeC5 | 2iA3,4diMeC5 | 2iA4,4diMeC5 | 2iA3EtC5 |

The chain lengths of the Guerbet alcohols have an effect on the physical properties of the aviation fuel composition indicated above, and in particular on the freezing and cloud points of the composition, whereby higher chain lengths result in higher freezing points. According to the invention only low molecular weight Guerbet alcohols are therefore used for the energy providing component. The term "low molecular weight Guerbet alcohol" as used in the present description refers either to a Guerbet alcohol having a number of carbon atoms of equal to or less than 12 or to a mixture of Guerbet alcohols having the carbon atom number distribution or mean value centred at or below 12. For illustrating the centre of the carbon atom number distribution, it is assumed that a reaction product contains a mixture of Guerbet alcohols, where the alcohols having a carbon atom number of 8 are present in a first quantity $Q_1$ (expressed in mol), the alcohols having a carbon atom number of 9 are present in a second quantity $Q_2$ (expressed in mol), and the alcohols having a carbon atom number of 10 are present in a third quantity $Q_3$ (expressed in mol), the centre of the carbon atom number distribution will then be at $(8Q_1+9Q_2+10Q_3)/(Q_1+Q_2+Q_3)$. With $Q_1$=20%, $Q_2$=55%, and $Q_3$=25%, the centre of the carbon atom number distribution will be at 9.05. In general, the centre of the carbon atom numbers is determined by the following equation:

$$C_{cd} = \frac{\sum_i C_i \cdot Q_i}{\sum_i Q_i}$$

wherein $C_{cd}$ is the centre of the carbon atom number distribution of the Guerbet alcohol mixture, Ci is the carbon atom number of Guerbet alcohol component i, and Qi is the quantity of Guerbet alcohol component i.

To summarize, the Guerbet alcohols may contain 4, 5, 6, 7, 8, 9, 10, 11, 12 carbon atoms, in case only one Guerbet alcohol is used for the blend. If a mixture of one or more different Guerbet alcohols is used, also Guerbet alcohols with higher carbon numbers can be included in the composition (e.g. containing 13, 14, 15, 16, 17, 18 carbon atoms), provided that the mean value is centred at or below 12.

Preferably low molecular weight Guerbet alcohols are used having a number of carbon atoms or a centre of the carbon atom number distribution of equal to or less than 10, and more preferably of between 6 and 10.

One of the problems posed by aviation fuels based on hydrocarbons such as Jet A or Jet A-1 is that they are produced starting from, non-renewable starting materials of fossil origin, like petroleum. Thus, according to a specific embodiment of the invention at least a portion, of the carbon atoms of the Guerbet alcohol(s) comprised in the aviation fuel is of renewable origin. As explained above, in a living organism the $^{14}C/^{12}C$ ratio is kept constant by continually exchanging the carbon with the external environment, the mean $^{14}C/^{12}C$ ratio being equal to $1.2\times10^{-12}$. Therefore, the presence of $^{14}C$ in a material gives an indication with regard to the materials origin being a renewable starting material and not a fossil one. The content of the renewably based carbon of a material may be assessed by standard methods, as for example mass spectrometry (ASTM-D6866).

As renewable starting materials plant materials, materials of animal origin or materials resulting from recovered materials (recycled materials) may be used. Plant materials may be for example derived from sugar and/or starches containing plants, such as sugar cane, sugar beet, date palm, sugar palm, corn, wheat, potato, algae and the like.

As explained above, for the production of Guerbet alcohols primary alcohols are used as starting materials. Said primary alcohols may be produced by fermentation from biomass using biocatalysts. The biocatalyst may be one or more microorganism (e.g. yeast, bacteria, fungi) capable of forming one or a mixture of two or more different alcohols. Fermentation methods and the respective microorganisms used for fermentation are known in the state of the art, and e.g. described in WO 2009/079213.

According to this specific embodiment of the invention, the process for formation of Guerbet alcohols from biomass starts for example with the formation of primary alcohols from biomass as explained above, and conversion into Guerbet alcohols via the so called Guerbet reaction.

Alternatively, Guerbet alcohols may be produced starting from one or more aldehydes by aldol condensation and subsequent hydrogenation to the dimer alcohol(s). The aldehydes used may be provided by hydroformylation (also known as oxo process) of alkenes using a mixture of carbon monoxide and hydrogen in the presence of a catalyst. According to reaction conditions and particularly the catalyst used in the process, isomeric products ('iso') may be present in the reaction mixture, which should be separated, e.g. by distillation, as those compounds cannot be condensed in the Guerbet reaction. The separation can be done either before or after the aldolisation reaction. A process for the production of Guerbet alcohols by hydroformylation is for example described in U.S. Pat. No. 4,684,750 and Platinum Metals Rev., 2007, 51, (3), 116-126.

According to a further specific embodiment, the alkenes used in the oxo process may also be obtained from renewable starting materials, by fermentation of biomass and dehydration of the alcohol(s) obtained in order to produce the alkene.

Aviation fuel additives may also form part of the aviation fuel. Additives are hydrocarbon soluble compounds added to the above specified energy providing component for designing or enhancing certain fuel properties and/or fuel handling. The additives are the same as those typically used in the prior art for jet fuels and comprise icing inhibitors, antioxidants, corrosion inhibitors, lubricity improvers, metal deactivators, static dissipators, electrical conductivity additives, biocides, thermal stability improvers or their mixtures in a parts per million or per mill concentration range, whereby the sum of all additives does preferably not exceed 2% by weight, and more preferably not 1% by weight of the aviation fuel.

Icing inhibitors prevent free water present in the fuel from forming ice crystals that may cause filter plugging by combining with the water molecules and thereby lowering the freezing point of the mixture. As an example di-ethylene glycol monomethyl ether (di-EGME) or ethylene glycol monoethyl ether may be mentioned.

Antioxidants improve the reliability of the fuelling and combustion system by preventing the formation of peroxides, which can attack elastomeric fuel system parts, gums that may lead to engine deposits and particulates potentially plugging filters. Antioxidants are usually based on alkylated phenols like for instance 2,6-ditertiary butyl-4-methyl phenol.

Electrical conductivity improvers, also referred to as static dissipator, additives enhance the poor electrical conductivity of the fuel to a certain value upon delivery into the aircraft. Currently only one static dissipator, Stadis® 450 containing dinonylnaphthylsulfonic acid, is approved for use in jet fuels.

Biocides are designed to prevent microbiological contamination of the fuel by inhibiting growth of microorganisms like bacteria and fungi, Biobor™ and Kathon™ are currently approved biocides.

Fuels for military jet engines use thermal stability improvers containing dispersants helping to keep potential insolubles in solution, preventing them from forming gums and sediments. The additive is genetically known as "+100" and presently only approved for use in military aircrafts.

In the following, examples for aviation fuel compositions according to the present invention are given together with test results concerning the qualification of the respective composition as on-specification fuel.

Example 1

A mixture of hydrocarbons conforming to the distillation range specified in the Jet A-1 standard DBF STAN 91-91 is blended with 2-ethylhexanol in a ratio of 90 vol. %/10 vol. %.

The following Table 3 compares values measured for the composition according to Example 1 with the respective specifications defined in DBF STAN 91-91.

TABLE 3

Properties of aviation fuel composition according to example 1 as compared to DEF STAN 91-91 specifications

| Pos. | Property | Units | DEF STAN 91-91 Limits | 10% 2-ethylhexanol/90% hydrocarbon mixture (vol.) |
|---|---|---|---|---|
| 1 | Density | $kg/m^3$ | Min 775.0 Max 840.0 | 796.4 |
| 2 | Distillation D86 | End Point ° C. | Max 300.0 | 245.6 |
| 3 | Net Heat Value | MJ/kg | Min 42.80 | 42.9 |
| 4 | Acidity | mg KOH/g | Max 0.015 | 0.015 |
| 5 | Freezing Point | ° C. | Max −47.0 | −60 |
| 6 | Smoke Point | mm | Min 25.0 | 28 |
| 7 | Flash Point | ° C. | Min 38.0 | 60 |
| 8 | Viscosity at −20° C. | $mm^2/s$ | Max 8.000 | 3.861 |
| 9 | Corrosion on Cu-plate | Class | No. 1 | No. 1 |
| 10 | Existent Gum | mg/100 ml | Max 7 | 7 |
| 11 | Electrical Conductivity (20° C.) | pS/m | Min 50<br>Max 600 | 65 |

As can be seen from the table above, the composition meets the basic properties specified in DEF STAN 91-91 for Jet A-1 turbine fuels, it is emphasised that the required electrical conductivity is already achieved by the composition as such, i.e. without addition of a static dissipator like Stadis® 450 as usually necessary for Jet A-1 fuels comprised of a hydrocarbon mixture only. The increase in electrical conductivity is due to the blending with the 2-ethylhexanol, as could be verified by measuring a value of 31 pS/m for the electrical conductivity of the hydrocarbon mixture used for the above blend.

Example 2

A mixture of commercially available Jet A-1 (produced by LOTOS S.A., Poland) fuel blended with 2-ethyl-1-hexanol in a ratio of 90 vol. %/10 vol. %.

The following Table 4 compares values measured for the composition according to Example 2 with the respective specifications defined in DEF STAN 91-91.

TABLE 4

Properties of aviation fuel composition according to example 2 as compared to DEF STAN 91-91 specifications

| Pos. | Property | Units | DEF STAN 91-91 Limits | 10% 2-ethylhexanol/90% hydrocarbon mixture (vol.) |
|---|---|---|---|---|
| 1 | Density | $kg/m^3$ | Min 775.0 Max 840.0 | 796.7 |
| 2 | Distillation D86 | End Point ° C. | Max 300.0 | 255.8 |
| 3 | Net Heat Value | MJ/kg | Min 42.80 | 42.982 |
| 4 | Acidity | mg KOH/g | Max 0.015 | <0.01 |
| 5 | Freezing Point | ° C. | Max −47.0 | −60 |
| 6 | Smoke Point | mm | Min 25.0 | 28 |
| 7 | Flash Point | ° C. | Min 38.0 | 65 |
| 8 | Viscosity at −20° C. | $mm^2/s$ | Max 8.000 | 3.82 |
| 9 | Corrosion on Cu-plate | Class | No. 1 | No. 1 |
| 10 | Existent Gum | mg/100 ml | Max 7 | 7 |
| 11 | Electrical Conductivity (20° C.) | pS/m | Min 50 Max 600 | 90 |

As can be seen from this table, this composition also meets the basic properties specified in DEF STAN 91-91 for Jet A-1 turbine fuels. It is noted that electrical conductivity achieved with this composition is somewhat higher than in the composition according to example 1, which is mainly due to the use of a static dissipator in Jet A-1 fuel forming the hydrocarbon mixture component in the present example.

Example 3

Commercially available Jet A-1 (produced by LOTOS S.A., Poland) fuel was blended with a mixture of C8+C9+C10 Guerbet alcohols (C9 alcohols: 48.7 wt %, C10 alcohols: 48.6 wt %, C8 alcohols (2-Ethylhexanol); 2.8 wt %; Acidity<0.03 mgKOH/g) in three different percentages and tested for its electrical conductivity. The test results are shown in Table 5 below.

TABLE 5

Electrical conductivity of Jet A-1 fuel and Jet A-1/Guerbet alcohol blends

| | | Jet-A1 + C8 + C9 + C10 Guerbet alcohols | | |
|---|---|---|---|---|
| | Jet A-1 | 2% | 5% | 10% |
| Electrical conductivity [pS/m] | 49 | 79 | 84 | 83 |

As can be seers from the table above, already low concentrations of Guerbet alcohols improve the electrical conductivity of the jet fuel composition significantly.

Example 4

A mixture of commercially available Jet A-1 (produced by LOTOS S.A., Poland) fuel blended with 2-ethylhexanol in a ratio of 95 vol. %/5 vol. %.

Example 5

A mixture of commercially available Jet A-1 (produced by LOTOS S.A., Poland) fuel blended with 2-ethylhexanol in a ratio of 80 vol. %/20%.

Tests:

The aptness of a blend of Jet A-1 fuel with 2-ethylhexanol for use as aviation turbine fuel has been tested using blends of different mixing ratios.

With respect to the requirement of a blend being usable as aviation fuel without modification of existing turbine engines, the similarity of flame characteristics of blends according to Example 2, Example 4, and Example 5 with the key characteristics of a flame from a fossil reference jet fuel has been determined in a combustion chamber laboratory test. The tests resulted in a close similarity between the flame characteristics of all three blends, whereby the blend according to Example 4 showed to be the best, and the blend according to Example 2 showed the second best similarity value.

With respect to the emission of greenhouse gases and emission of pollutants the differences between the blends according to Examples 2, 4, and 5 and a Jet A-1 fuel obtained from, fossil resources have been determined in a combustion chamber laboratory test. The results are listed in Table 4 below and show that the emissions of carbon monoxide, nitrogen dioxide, $NO_x$, and hydrocarbons are considerably reduced by the blends.

TABLE 6

Emissions of harmful gases relative to Jet A-1 fuel of fossil origin

| | Blend | $O_2$ | CO | $CO_2$ | NO | $NO_2$ | $NO_x$ | HC |
|---|---|---|---|---|---|---|---|---|
| Example 4 | 95/5 | −1.32 | −33.42 | 0.75 | 5.28 | −49.63 | −5.81 | −51.28 |
| Example 2 | 90/10 | −2.86 | −34.09 | 1.67 | 8.88 | −47.25 | −3.50 | 40.11 |
| Example 5 | 80/20 | −2.84 | −23.55 | 1.49 | 11.12 | −54.24 | −0.30 | −31.32 |

The values given in Table 6 indicate the emissions of various gases relative to Jet A-1 fuel in percent. The minus sign (–) means that the emission of the respective gas was lower, when compared to Jet A-1.

For manufacturing an aviation fuel composition according to an embodiment as explained above, a liquid phase hydrocarbon mixture and an alcohol component are provided and mixed in a ratio from the range of 99.9/0.1 to 70/30 with respect to vol. %. The alcohol component is selected from the group consisting of one or more Guerbet alcohols, having a number or mean number of carbon atoms, respectively, of equal to or less than 12.

While the present invention has been shown and described herein in what is believed to be the most practical and preferred embodiments, it is recognised that many alternatives, modifications, and variations will be apparent to those skilled in the art. Accordingly, the exemplary embodiments of the invention set forth herein are intended to be illustrative and not limiting in any way. Various changes may be made without departing from the spirit and scope of the present invention as defined in the following claims.

The invention claimed is:

1. A method of combusting an aviation fuel composition, the method comprising the steps of providing a liquid phase hydrocarbon mixture selected from the group consisting of jet fuels, the liquid phase hydrocarbon mixture optionally containing one or more additives, providing an alcohol component selected from the group consisting of one or more Guerbet alcohols, having a number or mean number of carbon atoms, respectively, of equal to or less than 12, mixing the liquid phase hydrocarbon mixture with the alcohol component in a ratio within the range of from 99.9/0.1 to 70/30 with respect to vol. % to form an aviation fuel mixture, wherein the liquid phase hydrocarbon mixture and the alcohol component make up 100% of the aviation fuel mixture, and combusting the aviation fuel mixture resulting from the mixing.

2. A method consisting of:

adding an alcohol component selected from the group consisting of one or more Guerbet alcohols, having a number or mean value of number of carbon atoms, respectively, of equal to or less than 12, in an amount of from 0.1 to 30 vol. %, as an energy providing component, to an aviation fuel composition comprising a hydrocarbon mixture selected from the group consisting of jet fuels with optional aviation fuel additives, in an amount of from 70 to 99.9 vol %, to form a Guerbet alcohol and hydrocarbon fuel mixture, wherein the hydrocarbon mixture has an electrical conductivity, and the Guerbert alcohol and hydrocarbon fuel mixture has a greater electrical conductivity than the conductivity of the hydrocarbon mixture; and combusting the Guerbet alcohol and hydrocarbon fuel mixture, as-is, to produce emissions having a lower amount of harmful exhaust gases than emissions resulting from combusting the hydrocarbon mixture alone.

3. The method of claim 2, wherein the Guerbet alcohol and hydrocarbon fuel mixture comprises i) 80 to 95 vol. % of the hydrocarbon mixture, and ii) 5 to 20 vol. % of the one or more Guerbet alcohols.

4. The method of claim 2, wherein the Guerbet alcohol and hydrocarbon fuel mixture comprises i) 85 to 95 vol. % of the hydrocarbon mixture, and ii) 5 to 15 vol. % of the one or more Guerbet alcohols.

5. The method of claim 2, wherein the energy providing component Guerbet alcohol and hydrocarbon fuel mixture comprises i) 98 to 99.9 vol. % of the hydrocarbon mixture, and ii) 0.1 to 2 vol. % of the one or more Guerbet alcohols.

6. The method of claim 2, wherein the hydrocarbon mixture comprises a kerosene-type fuel.

7. The method of claim 6, wherein said hydrocarbon mixture is Jet Fuel A, Jet Fuel A-1, or a combination thereof.

8. The method of claim 2, further comprising obtaining the one or more Guerbert alcohols, at least in part from renewable resources.

9. The method of claim 2, wherein the one or more Guerbet alcohols are selected from the group consisting of 2-Methyl-1-Pentanol, 2-Ethyl-1-hexanol, and 2-Propyl-1-heptanol.

10. The method of claim 2, wherein the one or more Guerbet alcohols is 2-Ethyl-1-hexanol.

11. The method of claim 2, wherein the one or more Guerbet alcohols is a mixture of Guerbet alcohols, comprising two or more Guerbet alcohols having carbon atom numbers of 5, 6, 7, 8, 9, or 10.

12. The method of claim 2, wherein the aviation fuel composition comprises one or more aviation fuel additives selected from the group consisting of anti-icing agents, antioxidants, corrosion inhibitors, lubricity improvers, metal deactivators, static dissipators, electrical conductivity additives, biocides, thermal stability improvers, or a mixture thereof.

13. A method comprising adding an alcohol component selected from the group consisting of one or more Guerbet alcohols, having a number or mean value of number of carbon atoms, respectively, of equal to or less than 12, in an amount of from 0.1 to 30 vol. %, to an aviation fuel composition comprising a hydrocarbon mixture selected from the group of jet fuels, in an amount of from 70 to 99.9 vol % to improve electrical conductivity of and to reduce emission of harmful exhaust gases of combustion of, the aviation fuel composition.

* * * * *